US011686469B2

(12) United States Patent
Juranitch

(10) Patent No.: US 11,686,469 B2
(45) Date of Patent: Jun. 27, 2023

(54) PLASMA ASSISTED, DIRTY WATER, DIRECT STEAM GENERATION SYSTEM, APPARATUS AND METHOD

(71) Applicant: XDI Holdings, LLC, Bedford, NH (US)

(72) Inventor: James Charles Juranitch, Fort Lauderdale, FL (US)

(73) Assignee: XDI Holdings, LLC, Bedford, NH (US)

( * ) Notice: Subject to any disclaimer, the term of this patent is extended or adjusted under 35 U.S.C. 154(b) by 218 days.

(21) Appl. No.: 15/166,109

(22) Filed: May 26, 2016

(65) Prior Publication Data

US 2016/0348895 A1 Dec. 1, 2016

Related U.S. Application Data

(60) Provisional application No. 62/166,536, filed on May 26, 2015.

(51) Int. Cl.
*F22B 37/48* (2006.01)
*F22B 3/02* (2006.01)

(52) U.S. Cl.
CPC ..... *F22B 37/48* (2013.01); *F22B 3/02* (2013.01)

(58) Field of Classification Search
USPC ..... 122/1 b
See application file for complete search history.

(56) References Cited

U.S. PATENT DOCUMENTS

| | | | | |
|---|---|---|---|---|
| 4,330,038 | A | 5/1982 | Soukup et al. | |
| 4,398,604 | A | 8/1983 | Krajicek et al. | |
| 4,498,542 | A | 2/1985 | Eisenhawer et al. | |
| 4,565,249 | A | 1/1986 | Pebdani et al. | |
| 5,020,595 | A | 6/1991 | Van Slyke | |
| 5,132,145 | A | 7/1992 | Valentian | |
| 7,931,083 | B2 | 4/2011 | Betzer Tsilevich | |
| 8,166,761 | B2 * | 5/2012 | Moghtaderi | F02C 1/10 60/651 |
| 2004/0055302 | A1 * | 3/2004 | Kalina | F01K 25/065 60/649 |
| 2009/0064581 | A1 * | 3/2009 | Nielsen | C10J 3/18 48/78 |
| 2013/0062189 | A1 | 3/2013 | Dighe | |
| 2014/0166934 | A1 | 6/2014 | Juranitch | |
| 2014/0305645 | A1 * | 10/2014 | Macadam | F22G 1/00 166/303 |
| 2015/0218469 | A1 * | 8/2015 | Sastri et al. | C10J 3/46 |
| 2015/0369025 | A1 | 12/2015 | Latimer et al. | |

* cited by examiner

*Primary Examiner* — Steven B McAllister
*Assistant Examiner* — John E Bargero
(74) *Attorney, Agent, or Firm* — Dykema Gossett PLLC

(57) ABSTRACT

Embodiments of the present disclosure include a system, method, and apparatus comprising a direct steam generator configured to generate saturated steam and combustion exhaust constituents.

18 Claims, 5 Drawing Sheets

| Point | Condition |
|---|---|
| A | 6.5 MPa Steam |
| B | 5.0 MPa Condensate |
| C | 5.0 MPa Condensate |
| D | 5.0 MPa Steam |

PLASMA ASSISTED, DIRTY WATER, DIRECT STEAM GENERATION SYSTEM, APPARATUS AND METHOD

CROSS-REFERENCE TO RELATED APPLICATION

This application claims priority to U.S. provisional patent application No. 62/166,536 entitled "PLASMA ASSISTED, DIRTY WATER, DIRECT STEAM GENERATION SYSTEM, APPARATUS AND METHOD," filed 26 May 2015, which is hereby incorporated by reference as though fully set forth herein.

FIELD

Embodiments of the present disclosure relate generally to plasma assisted, dirty water, direct steam generation system, apparatus, and method.

DESCRIPTION OF THE RELATED ART

Direct Steam Generators (DSG) are not well accepted in SAGD and Cyclic Steam Stimulation (CSS) heavy oil recovery. This is due to the fact that the steam is diluted with exhaust gas from the combustion process in a DSG. Many in the oil industry feel that exhaust gas, primarily made up of CO2 and N2, has negative effects in heavy oil production in most wells. This thought process has evolved from the opposite view as disclosed in U.S. Pat. No. 4,565,249, titled "Heavy Oil Recovery Process Using Cyclic Carbon Dioxide Steam Stimulation" and U.S. Pat. No. 5,020,595, titled "Carbon Dioxide-Steam CO-Injection Tertiary Oil Recovery Process" where CO2 was thought to be a benefit when injected in a heavy oil recovery process. The current belief is that no exhaust constituents are the preferred composition of production steam in most of the wells executing heavy oil recovery processes such as SAGD. Dealing with the inevitable solids in all types of steam production has always been problematic. The heavy oil industry today uses 2 to 4 barrels of water (turned into steam) for every barrel of oil it produces. The oil and gas industry currently utilizes extensive water treatment technologies at the well site to clean its process water before making steam, typically in the more accepted Once Through Steam Generators (OTSG). Once Through Steam Generators do not have exhaust gas constituents in the steam they produce, which is one of the primary reasons they are favored. Unfortunately, they do require high quality water to operate on. It is a common comment that modern SAGD sites, due to OTSGs, are really large and expensive water treatment plants attached to a small well pad. The water treatment plant and process currently used in conventional OTSG requires extensive labor and large amounts of expendable chemicals and energy to operate. During normal operations, these water treatment plants produce a significant waste stream of lime sludge and other byproducts that must be disposed of Due to the operational expense and capital required to build ever more complete water treatment plants, the norm in the oil industry is to limit the steam quality from 70 to 80% in the OTSG. In other words 20 to 30% of the liquid input or feed water stays in a liquid state and is not converted to steam. This practice helps to limit the deposits that will build up inside the OTSG, which will eventually disable its operation. To produce a higher quality steam in an OTSG, the water would first have to be treated to a higher purity level adding additional expense and complexity to an already too large and too complex water treatment system. Unfortunately, the practice of low quality OTSG steam production is energy and resource inefficient since the spent process water, or blow down, wastes most of its energy and water resource without recovering any oil product. This practice produces excessive greenhouse gasses (GHG) from the wasted energy and an additional waste stream from the OTSG, which is the blow down fluid. The amount of blow down produced is significant. Only about ⅓ of the blow down water is recovered in most systems. The balance of the blow down waste water contains many contaminated solids, such as CAO3 and MGO3. This blow down must be disposed of in deep wells or again run through very expensive and complex processes to reclaim the valuable water content.

The DSG boilers do not, in many cases, suffer from most of the above problems. The current technology DSG boilers need relatively clean feedwater but not to the level required by OTSG. The DSG boilers typically have limited or no blow down. Their biggest problem is that their steam is contaminated by the exhaust constituents they produce through combustion. They also typically produce an inorganic and ash waste stream, which has to then be dealt with and transported to a land fill.

DSG boilers are typically more efficient than OTSG boilers. This is due to the elimination of the tube heat exchanger used in a OTSG boiler. In comparison, in a DSG boiler, the oxidized fuel transfers its energy directly to the process steam with no intermediate tube. This higher efficiency is a desirable trait. U.S. Pat. No. 7,931,083 titled "Integrated System and Method for Steam-Assisted Gravity Drainage (SAGD)-Heavy Oil Production to Produce Super-Heated Steam Without Liquid Waste Discharge"; U.S. Pat. No. 4,498,542 titled "Direct Contact Low Emission Steam Generating System and Method Utilizing a Compact, Multi-Fuel Burner"; and U.S. Pat. No. 4,398,604 titled "Method and Apparatus for Producing a High Pressure Thermal Vapor Stream" all discuss the positive traits of DSG but offer no solution to removing the bad traits associated with the exhaust constituents such as CO2 and N2 from the steam product. As noted, this makes the existing DSG technology unacceptable and a non-starter for modern heavy oil recovery. A method, apparatus and system of eliminating the bad traits associated with the DSG's exhaust constituents is required to allow their acceptance in the oil recovery sector and other industries.

SUMMARY OF THE INVENTION

Embodiments of the present disclosure include a system for generating steam, comprising a direct steam generator. A feed conduit is fluidly coupled to the direct steam generator configured for delivery of feedwater to the direct steam generator, wherein the feedwater includes organic and inorganic constituents. A fossil fuel source is fluidly connected to the direct steam generator to provide power to operate the direct steam generator. At least one of an air conduit and an oxygen enriched air conduit is fluidly coupled with the direct steam generator. A close coupled heat exchanger is fluidly coupled to the direct steam generator. The close coupled heat exchanger is configured to route saturated steam and combustion exhaust constituents produced by the direct steam generator through a condenser portion of the close coupled heat exchanger via a condenser side steam conduit and configured to condense the saturated steam to form a condensate. A separation tank and water return system is fluidly coupled to a condenser side condensate conduit of the condenser portion of the close coupled heat exchanger, wherein the separation tank and water return system is configured to separate the combustion exhaust constituents from the condensate. An evaporator portion of the close coupled heat exchanger is fluidly coupled with the separation tank and water return system via an evaporator side condensate conduit. The evaporator portion is configured to evaporate the condensate from the separation tank and water return system via heat transfer between the condenser portion and evaporator portion to form steam.

Embodiments of the present disclosure include a system for generating steam, comprising a plasma assisted vitrifier that includes a plasma torch and a melt chamber configured to contain a molten metal pool. A cooling ring is disposed around a base of the plasma assisted vitrifier and the molten metal pool. A feed conduit is fluidly coupled to the plasma assisted vitrifier configured for delivery of feedwater to the plasma assisted vitrifier, wherein the feedwater includes organic and inorganic constituents. A fossil fuel source is fluidly coupled to the plasma assisted virtifier to provide power to operate the direct steam generator. At least one of an air conduit and an oxygen enriched air conduit is fluidly coupled with the plasma assisted vitrifier. A close coupled heat exchanger is fluidly coupled to the plasma assisted vitrifier, the close coupled heat exchanger is configured to route saturated steam and combustion exhaust constituents produced by the plasma assisted vitrifier through a condenser portion of the close coupled heat exchanger via a condenser side steam conduit and configured to condense the saturated steam to form a condensate. A separation tank and water return system is fluidly coupled to a condenser side condensate conduit of the condenser portion of the close coupled heat exchanger, wherein the separation tank and water return system is configured to separate the combustion exhaust constituents from the condensate. An evaporator portion of the close coupled heat exchanger is fluidly coupled with the separation tank and water return system via an evaporator side condensate conduit. The evaporator portion is configured to evaporate the condensate from the separation tank and water return system via heat transfer between the condenser portion and evaporator portion to form steam.

Embodiments of the present disclosure include a system for generating steam, comprising a plasma assisted vitrifier that includes a plasma torch and a melt chamber configured to contain a molten metal pool, wherein the plasma assisted vitrifier is configured as a direct steam generator. A cooling ring is disposed around a base of the plasma assisted vitrifier and the molten metal pool. A feed conduit is fluidly coupled to the plasma assisted vitrifier and configured for delivery of feedwater to the plasma assisted vitrifier, wherein the feedwater includes organic and inorganic constituents. A fossil fuel source is fluidly coupled to the plasma assisted virtifier to provide power to operate the direct steam generator. At least one of an air conduit and an oxygen enriched air conduit is fluidly coupled with the plasma assisted vitrifier. A close coupled heat exchanger is fluidly coupled to the plasma assisted vitrifier, the close coupled heat exchanger is configured to route saturated steam and combustion exhaust constituents produced by the plasma assisted vitrifier through a condenser portion of the close coupled heat exchanger via a condenser side steam conduit and configured to condense the saturated steam to form a condensate. A separation tank and water return system is fluidly coupled to a condenser side condensate conduit of the condenser portion of the close coupled heat exchanger, wherein the separation tank and water return system is configured to separate the combustion exhaust constituents from the condensate. An evaporator portion of the close coupled heat exchanger is fluidly coupled with the separation tank and water return system via an evaporator side condensate conduit, wherein the evaporator portion is configured to evaporate the condensate from the separation tank and water return system via heat transfer between the condenser portion and evaporator portion to form steam.

DETAILED DESCRIPTION

Embodiments of the present disclosure relate generally to a method, apparatus and system for the generation of steam from dirty water, salty water and/or produced water. The system, apparatus and method, in a preferred embodiment, can include a plasma assisted Direct Steam Generation (DSG) unit. A preferred embodiment can include a Zero Liquid Discharge (ZLD), a Zero Waste and a Zero Greenhouse Gas generation system, apparatus and method. Embodiments of the present disclosure can produce a steam product, which can be used in any steam application, but is particularly well suited for Steam Assist Gravity Drain (SAGD) heavy oil applications. CO2 and exhaust constituents can be separated from the steam product and, in some embodiments, sequestered.

Embodiments of the present disclosure can separate the generated process steam produced by a DSG from its exhaust combustion constituents. When oxygen or highly oxygen enriched air is used for combustion, the method and system will gain efficiency and isolate the exhaust constituents primarily made up of CO2 to minimize the generation of GHG. Due to the lack of N2, when highly oxygen enriched air is used for combustion, the NOx production is also minimized or eliminated without the use of after treatments. The plasma assisted or non-plasma assisted DSG can also operate on produced water, sewage, bitumen production pond water, and/or extremely dirty and salty water. Embodiments of the present disclosure eliminate all waste streams including blow down and can be a Zero Liquid Discharge, a Zero Green House Gas and a Zero Waste system, apparatus and method. The method, apparatus and system of the present disclosure, can use fossil fuel, thermal plasma, a multiphase heat exchanger and other components to accomplish its goals, in various embodiments.

Figure 1:
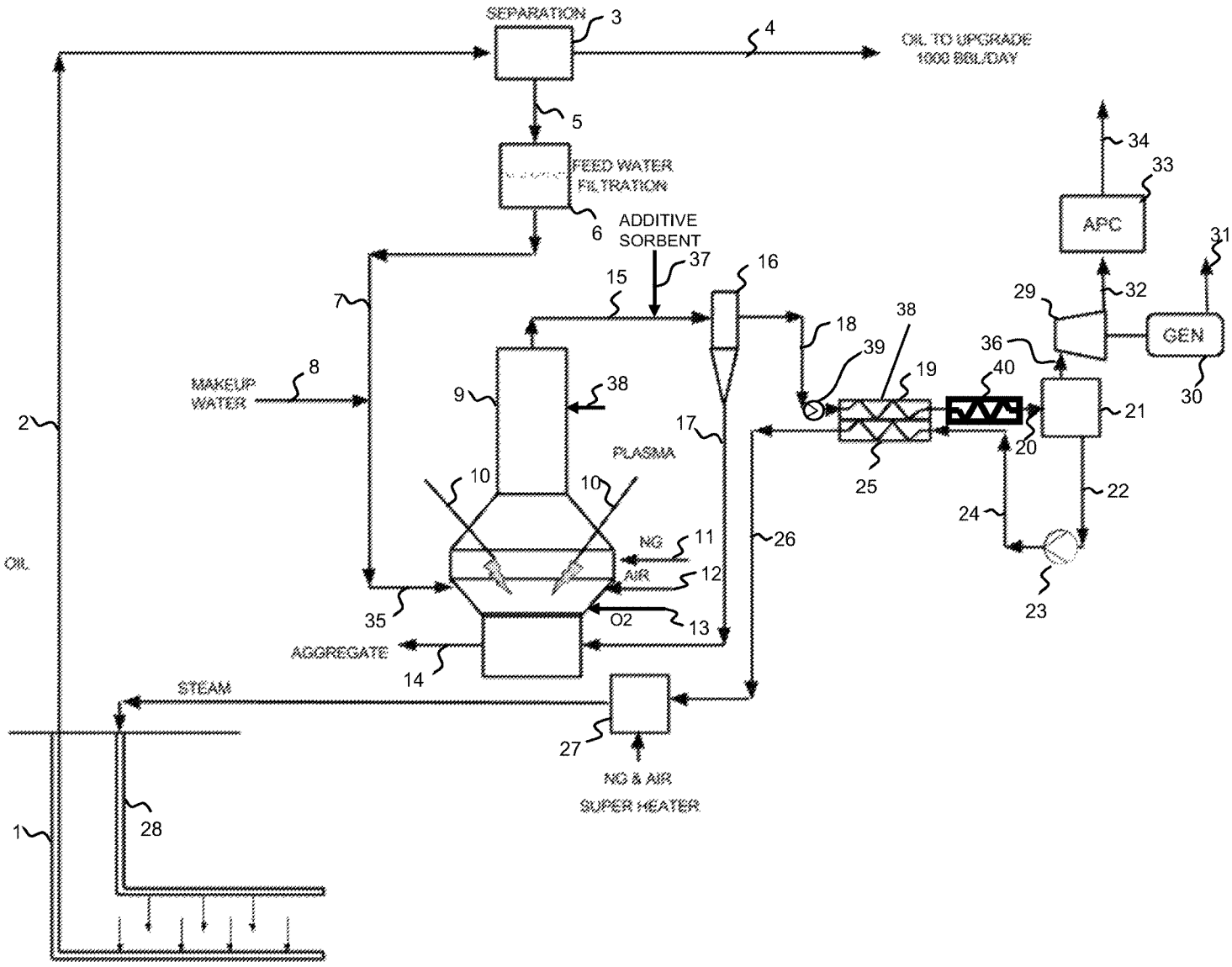
FIG. 1 depicts a simplified schematic representation of a plasma assisted direct steam generation system, in accordance with embodiments of the present disclosure.

Referring first to FIG. 1, production wellbore 1 serves as a conduit for produced water and bitumen product associated with a SAGD heavy oil operation. The produced water can be water that flows into the production wellbore 1 from underground formations and/or steam that has been injected into the ground via steam injection conduit 28 that has condensed into liquid. For example, the produced water and bitumen product can flow from a subterranean formation through the production wellbore 1 to the surface. The example used for clarity in this document is a SAGD heavy oil application. Embodiments of the present disclosure are not limited to only SAGD applications. For example, embodiments of the present disclosure can be used in any application that requires steam generation.

Production conduit 2 can be fluidly coupled to the oil separation system 3 and can carry the produced water and bitumen to oil separation system 3. Oil separation system 3 can be implemented many different ways at many different well sites, but can typically include a Free Water Knock Out (FWKO) and other heavy oil separation systems known to those skilled in the art. Crude oil conduit 4 can be fluidly coupled to the oil separation system 3 and can carry an end product of a SAGD operation. For example, the crude oil conduit 4 can carry an acceptable crude oil product that then can be delivered for further processing to a refinery. Diluent additive, centrifuges and other bitumen upgrade processes have not been discussed, however can additionally be included in embodiments of the present disclosure. In some embodiments, 1,000 barrels per day of crude oil product can be produced as an end product of the SAGD operation. However, examples are not so limited and greater than or fewer than 1,000 barrels per day can be produced.

Figure 3:
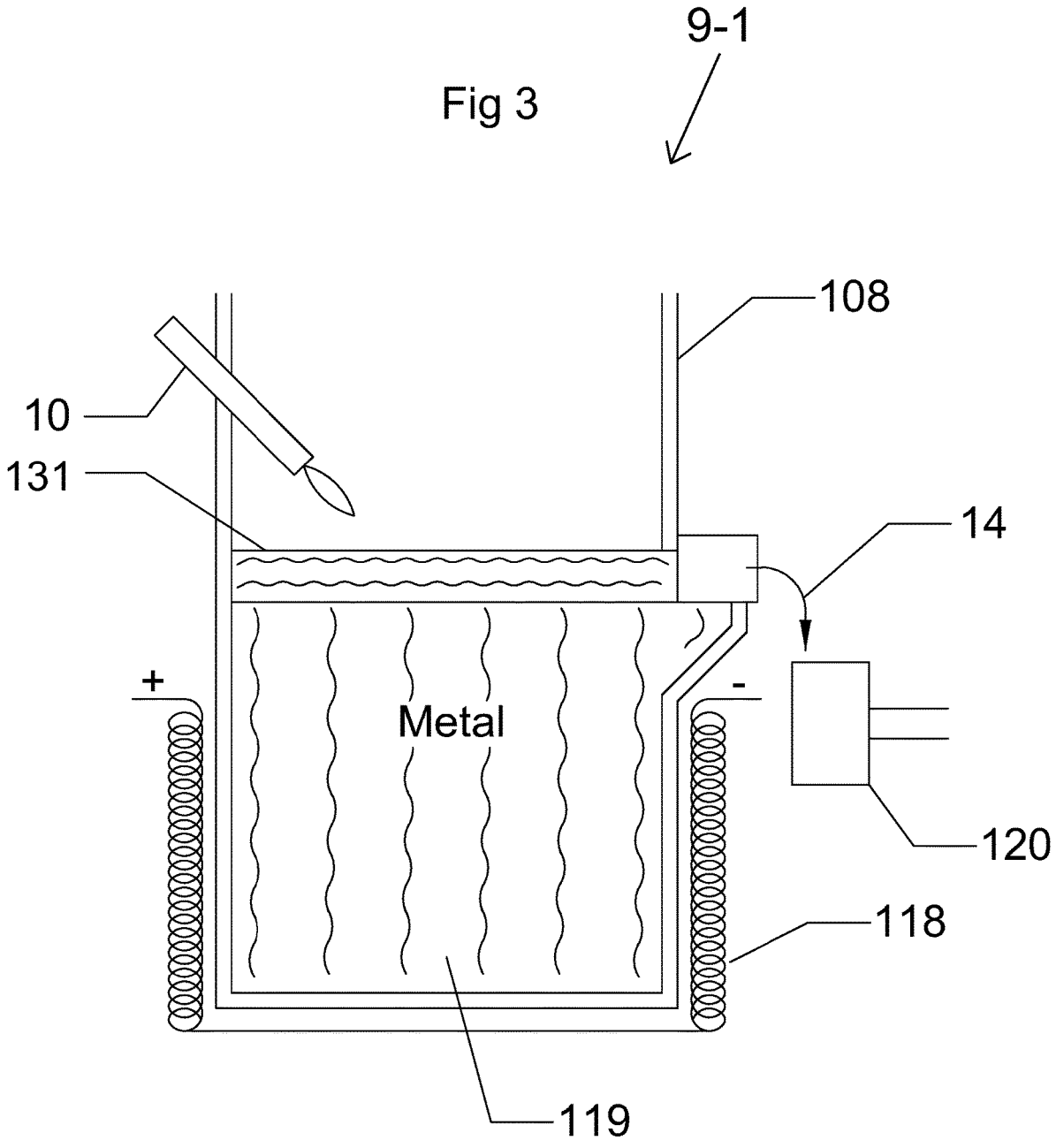
FIG. 3 depicts a more detailed side view of an embodiment of a lower section of the inductive based plasma assisted vitrifier depicted in FIG. 1, in accordance with embodiments of the present disclosure.
Figure 4:
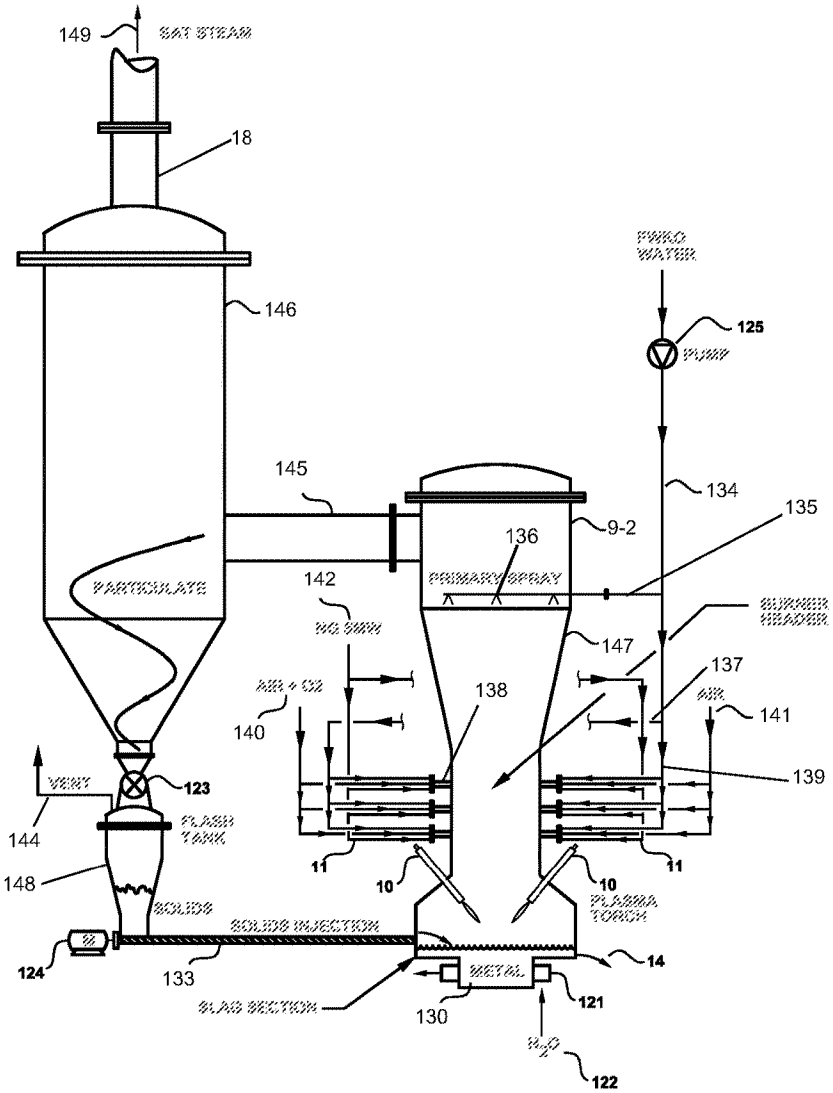
FIG. 4 depicts a non-inductive based plasma assisted vitrifier that includes a cooling ring, in accordance with embodiments of the present disclosure.

Separated water conduit 5 can be fluidly coupled to the oil separation system 3 and a feed water filtration system 6. The separated water conduit 5, can carry water, also known as "Produced Water," which has been separated from the crude oil product, to the feed water filtration system 6, which can filter the separated water and output filtered water. The filtered water can travel through a filtered water conduit 7, and can optionally be augmented by makeup water which could be dirty, salty water, sewage, or bitumen production pond water to create a feed stock. The makeup water can be fed through a makeup water conduit 8, fluidly coupled with the separated water conduit 7. The feed stock (optionally augmented with the makeup water) enters a Plasma Assisted Vitrifier (PAV) 9 via feed conduit 35. FIGS. 3 and 4 illustrate particular embodiments of the PAV 9. A number of plasma melt systems, such as Alter NRG's coke based plasma melter or Plasco's gas polishing and plasma vitrifying process could potentially be substituted for the PAV 9 with varying degrees of success.

In a preferred embodiment, the feed stock can enter the PAV 9, as shown in FIG. 1 via feed conduit 35, and as discussed herein. The feed stock can be made up of water, organic and/or inorganic material. Some embodiments of the present disclosure can include a PAV 9, as described and taught in US publication no. 2014/0166934 titled, "Inductive Bath Plasma Cupola," which is incorporated herein by reference. A second preferred PAV 9 example is further discussed herein, in relation to FIG. 4. One or more fossil fueled torches 11, as shown and discussed in relation to FIGS. 1 and 4, and/or one or more plasma torches 10, as shown in FIGS. 1, 3, 4, and 5 (depicted as plasma torches 210 in FIG. 5) are again described in US publication no. 2014/0166934. One or more of each torch style can be utilized with the PAV 9, in embodiments of the present disclosure. The one or more fossil fueled torches 11 can be operated on fuels that include, but are not limited to well head gas, natural gas, propane, diesel, and/or bitumen. A detailed side view of the lower section 108 of PAV 9 in FIGS. 1 and 5, as described in US publication no. 2014/0166934, is shown in FIG. 3, in accordance with embodiments of the present disclosure. As depicted in FIG. 3, the PAV 9-1 includes the metal thermal pool 119, the inductor 118 (e.g., inductive furnace) and the solids feedstock working area 131, as taught in US publication no. 2014/0166934. The PAV 9-1 further includes plasma torches 10 and vitrified product 14.

FIG. 4 depicts a non-inductive based PAV 9-2 that includes a cooling ring, in accordance with embodiments of the present disclosure. In a preferred embodiment, the PAV 9-2 does not include inductor 118, as shown in the PAV 9-2 in FIG. 4, and will only have a metal pool cooling ring 121 disposed below the solids feedstock working area and a surface of the metal thermal pool 130 on an outside of a base of the PAV 9-2 (e.g., circumferentially disposed about the base of the PAV 9-2). The metal pool cooling ring 121 can be provided with indirect contact to the internal molten metal thermal pool 130 through a wall of the PAV 9-2. The metal pool cooling ring 121 will facilitate the reduction of energy in the metal thermal pool 130 through transfer of heat to water 122 passing through the metal pool cooling ring 121. In some embodiments, the metal pool cooling ring 121 can include a water inlet and a water outlet, as depicted.

In some embodiments, the metal pool cooling ring 121 can be a cooling jacket that is disposed around a perimeter of the base of the PAV 9-2. In an example, the metal pool cooling ring 121 can be built into the base of the PAV 9-2. Alternatively, the metal pool cooling ring 121 can have a general shape of a hollow cylinder and can be attached to an outer surface of the base of the PAV 9-2. For example, the metal pool cooling ring 121 can be formed from hollow semi-cylindrical components that are connected to one another to form the metal pool cooling ring 121.

In some embodiments, vitrified product 14 can be deposited onto a spinner wheel 120 or multiple wheels to begin a fiberizing process, as shown in FIG. 3. FIG. 3 depicts a more detailed side view of an embodiment of a lower section of an inductive based plasma assisted vitrifier in FIGS. 1 and 5, in accordance with embodiments of the present disclosure. The spinner wheel 120 may be part of an internal fiberizing process or an external fiberizing process. As shown, the spinner wheel 120 can be disposed next to the PAV 9-1, such that vitrified product 14 produced by the plasma based melter contacts the spinner wheel 120. The wheels of an external fiberizing process can also be used to manufacture a fracking sand product and other proppants known to those skilled in the art. As used herein, frac sand can be defined by standards ISO 13503-2 or API RP 56/58/6. Forced cooling systems using air or liquid, such as water, can in some embodiments be used to manufacture aggregate and facilitate the separation of reclaimed metals. This process is known to those skilled in the art. As used herein, aggregate can be defined by standards ASTM D2940/D2940M-09.

Figure 5:
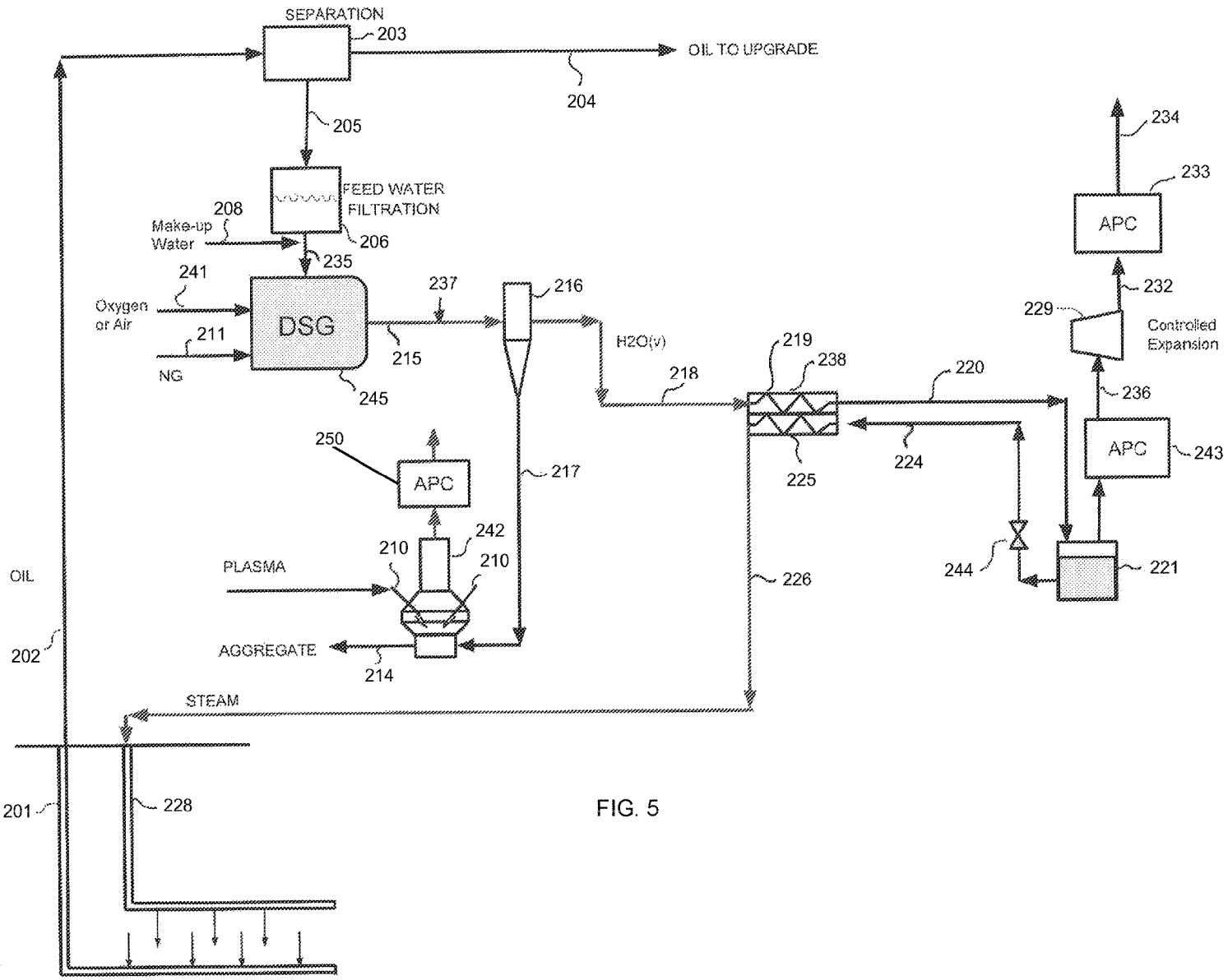
FIG. 5 depicts a non-plasma assisted direct steam generation system with an optional plasma assisted vitrifier and an optional air pollution control process fluidly coupled to an exhaust conduit and particulate cleaning system, in accordance with embodiments of the present disclosure.

With further reference to FIG. 1, in a preferred embodiment, only highly oxygen enriched air is used for combustion in a near stoichiometric relationship and can be injected into the PAV 9 via oxygen enriched air conduit 13 in FIG. 1 or directly into the non-plasma assisted DSG by conduit 241, as shown in FIG. 5. The oxygen enriched air can include a percentage of oxygen by volume in a range from 25 percent to 100 percent. As depicted in FIG. 1 and FIG. 5, the fossil fuels injected via the one or more fossil fuel torches 11 and organic product included in the feed stock fed to the PAV 9 or DSG 245, via the feed conduit 35 or feed conduit 235 are oxidized in the PAV 9 or DSG 245 and are converted to primarily water and steam, which helps the overall process, while substantially generating pure CO2 at exhaust conduit 34 or exhaust outlet 234. The CO2 could be re-injected in aging SAGD wells or other storage systems to minimize GHG production.

The CO2 could also be extracted at turbine feed conduit 36 or turbine feed conduit 236, depicted in FIG. 5, to facilitate high pressure injection. This method of steam and CO2 generation can be used in a positive way in many industries other than the oil recovery industry. Those skilled in the art will recognize the benefits of the processes described in the present disclosure when applied to the power generation industry.

Any particulate from the effluent produced by the PAV 9 can travel through saturated steam conduit 15. In some embodiments, sorbents and/or additives, such as lime, can be injected into the saturated steam conduit 15 via a conduit 37 to convert any carry over Sulfur or other undesirable elements. The saturated steam conduit 15 can be fluidly coupled to a particulate cleaning system 16, which is more fully discussed in relation to FIG. 4 (e.g., particulate cleaning system 146). Particulate matter extracted by the particulate cleaning system 16 can be fed into the PAV 9 via the solid feed conduit 17 and saturated steam can be fed to a saturated steam conduit 18.

As depicted in FIGS. 1, 4, and 5, the inorganic solids injected into PAV 9 and optional PAV 42 in FIG. 5 at feed conduits 35, 134 and solid feed conduits 17, 133 will be vitrified to form a vitrified product 14 and converted into useful reclaimed products such as fiber, aggregate, frac sand, sorbents, wall boards and many other valued products, as taught in U.S. provisional patent application No. 62/106,077, which is hereby incorporated by reference. For example, the vitrified product 14 can be converted via a spinner wheel 120 or forced cooling system, as discussed herein. FIG. 4 shows the additional detail of isolation valve 123 and motor 124, which turns the screw feeder inside solid feed conduit 133, or solid feed conduit 17 depicted in FIG. 1. A detail of a feedwater pump 125 is also shown in fluid communication with feed conduit 134 and primary injection conduit 135.

As depicted in FIG. 4, water can be fed to a pump 125 from a free-water knockout and can be pumped through a feed conduit 134. As discussed in relation to FIG. 1, makeup water can be injected into the feed conduit 134 downstream of the pump 125. In some embodiments, a primary injection conduit 135 can be fluidly coupled to the feed conduit 134. The primary injection conduit 135 can be fluidly coupled to the PAV 9-2 and can be configured to inject a feed stock into the PAV 9-2. In some embodiments, and as depicted in FIG. 4, an injector bar 136 can be fluidly coupled to the primary injection conduit 135. The injector bar 136 can extend from a side of the PAV 9-2 into and/or across a plasma chamber of the PAV 9-2. The feed conduit 134 can further be fluidly coupled to a cross-over injection conduit 137. The cross-over injection conduit 137 can be fluidly coupled to one or more injection manifolds 138 located on a first side of the PAV 9-2. In some embodiments, injection conduit 139 can be fluidly coupled to one or more injection manifolds 138 located on a second side of the PAV 9-2. The feed stock can be delivered to the PAV 9-2 via the injection manifolds 138, in some embodiments. In some embodiments, the injection manifolds 138 can be disposed on a first and second side of the PAV 9-2 in vertical stacks, as depicted in FIG. 4. In some embodiments, the injection manifolds 138 can be dispersed radially around a perimeter of the PAV 9-2. In some embodiments, the injection manifolds 138 can be staggered vertically about the plasma chamber and/or staggered radially about the plasma chamber. In some embodiments, the one or more injection manifolds 138 can be disposed above the one or more plasma torches 10, in some embodiments.

In some embodiments, an oxygen enriched air conduit 140 can supply oxygen enriched air to the PAV 9-2 and/or an air conduit 141 can supply air to the PAV 9-2 via the one or more injection manifolds 138. In some embodiments, each of the one or more injection manifolds 138 can include one or more injection nozzles configured to inject the feed stock, air, and/or oxygen enriched air into the plasma chamber. Air may or may not be fed to the PAV 9-2 via air conduit 141, or DSG 245 depicted in FIG. 5 via conduit 241, if oxygen or oxygen enriched air is injected via oxygen enriched air conduit 140, or conduit 241. Fuel conduit 142 can supply a fossil fuel, such as, but not limited to; Natural Gas, Well Head Gas, diesel, bitumen, propane and other fuels known to those skilled in the art to the PAV 9-2, or DSG 245. In some embodiments, the fuel conduit 142 can be fluidly coupled to the one or more injection manifolds 138. In some embodiments, the one or more injection manifolds 138 can each include separate nozzles for injection of one or more of the feed stock, air, oxygen enriched air, and/or fossil fuel.

A second, preferred PAV example, is shown in FIG. 4. One or more fossil fueled torches 11, 211 as shown and described in relation to FIGS. 1, 4, and 5 and/or one or more plasma torches 10, 210 as shown and described in relation to FIGS. 1, 3, 4, and 5 are again described in the above mentioned provisional application. In some embodiments, steam generated from the high pressure PAV 9-2 exits saturated steam conduit 145, which fluidly couples PAV 9-2 and a particulate cleaning system 146. The particulate cleaning system 146 can process the steam generated by the PAV 9-2. In some embodiments, the particulate cleaning system 146 can include cyclone separators, ceramic filters and other systems known to those skilled in the art. As discussed in relation to FIGS. 1 and 5, sorbents and/or additives, such as lime, can be injected into the saturated steam conduit 145, 215, or 15 via a conduit (e.g., conduit 37 depicted in FIG. 1, conduit 237 depicted in FIG. 5) to convert any carry over Sulfur or other undesirable elements. In some embodiments, the additives and/or sorbents could also be added directly to the PAV at location 147.

In some embodiments, as the saturated steam exits conduit 145 and enters the particulate cleaning system 146, exhaust gases, as well as particulate matter can be mixed with the saturated steam. The particulate cleaning system 146 (e.g., cyclone separator) can strip the particulate matter from the saturated steam, as depicted in FIG. 4. For example, as the saturated steam and hot exhaust gases enter the particulate cleaning system 146, the saturated steam and hot exhaust gases can rise to a top of the particulate cleaning system 146 and out saturated steam conduit 18. The particulate matter can fall to a bottom of the particulate cleaning system 146. In some embodiments, the particulate cleaning system 146 can include an isolation valve 123 located at a base of the particulate cleaning system 146, configured to allow particulate matter to pass into a flash tank 148 fluidly coupled to the particulate cleaning system 146. In some embodiments, as depicted, the flash tank 148 can include a vent 144 configured to maintain a particular pressure within the flash tank 148 (e.g., atmospheric pressure) that is less than a pressure of the particulate cleaning system 146. As such, when particulate matter and/or high temperature condensate from the particulate cleaning system 146 is allowed to flow into the flash tank 148, steam can be flashed from the condensate, prior to the particulate matter being fed through solid feed conduit 133.

In some embodiments, inorganic solids and/or semi-solids (e.g., particulate matter) can be fed into the PAV 9-2 via the solid feed conduit 133. The solid feed conduit 133 can include a screw feeder disposed inside solid feed conduit 133. The screw feeder can be driven by a motor 124, which turns the screw feeder and delivers solids and/or semi-solids from flash tank 148. The flash tank 148 can include a vent 144 configured to maintain a particular pressure within the flash tank 148 (e.g., atmospheric pressure).

If a blended steam and exhaust constituent product is desired, it could be harvested at saturated steam conduit 149. If a steam product is desired that is void of exhaust constituents then it can be further processed through a multiphase combined (close coupled) heat exchanger 38, as discussed in relation to FIG. 2.

Figure 2:
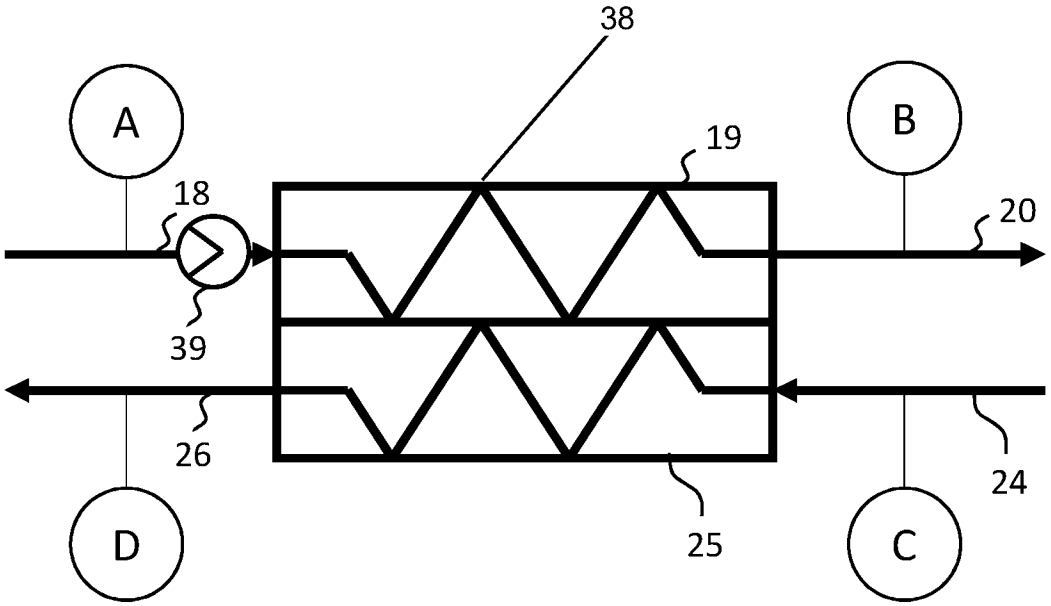
FIG. 2 depicts a multiphase close coupled heat exchanger, in accordance with embodiments of the present disclosure.

FIGS. 2 and 5 depict a multiphase close coupled heat exchanger 38, in accordance with embodiments of the present disclosure. In some embodiments, the saturated steam conduit 18 and 218 (FIGS. 1 and 2) can be fluidly coupled with the multiphase combined close coupled heat exchanger 38 and can feed processed steam from saturated steam conduit 18 into a condenser side 19 of the multiphase combined close coupled heat exchanger 38, as condenser side steam. In some embodiments, processed steam from DSG 245, PAV 9, PAV 9-1, and/or PAV 9-2 can be fed into the condenser side 19 of the close coupled heat exchanger 38. For example, steam 149 from saturated steam conduit 18, as depicted in FIG. 4, can be fed into the condenser side 19 of the close coupled heat exchanger 38. As a further example, steam from saturated steam conduit 218 can be fed into the condenser side 219 of the close coupled heat exchanger 238. In some embodiments of the present disclosure, an operating condition associated with the close coupled heat exchanger 38 can include the processed steam entering the hot side of the close coupled heat exchanger via saturated steam conduit 18 at a saturated steam condition of 6.5 megapascals (MPa). Processed steam may go through optional throttling valve 39 and can be condensed through condenser side 19, exiting the close coupled heat exchanger 38, as cold side steam, in a saturated steam condition at 5 MPA. In some embodiments, the throttling valve 39 can be adjusted to adjust a pressure of the processed steam traveling through saturated steam conduit 18 (e.g., condenser side steam conduit). These conditions are only one of an infinite number of combinations possible. Those skilled in the art will recognize the process will operate correctly if the condition of the processed steam entering the condenser side 19 via saturated steam conduit 18 is higher in energy than steam exiting an evaporator side 25 of the close coupled heat exchanger 38 via evaporator side steam conduit 26 and the condenser is effective enough to allow a phase change to occur by condenser side condensate conduit 20 of the condenser side 19. Thus, condenser side 19 operates as a condenser portion of the close coupled heat exchanger 38 and evaporator side 25 operates as an evaporator portion of the close coupled heat exchanger 38. An additional and optional feed water heat exchanger 40 can be used in an embodiment to improve the condenser process. As known by those skilled in the art, the additional heat exchanger 40 can be applied to any fluid that removes heat energy and is not required to only service the feed water. In some embodiments, the feed water heat exchanger 40 can condense a steam and/or cool a condensate exiting the hot side 19 of the close coupled heat exchanger 38.

As shown in FIGS. 1 and 5, the condenser side condensate (e.g., liquid distilled water and exhaust constituents) can be fed to separator tank 21 through condenser side condensate conduit 20. The liquid at or near boiling point and approximately 5 MPa can be fed to feedwater pump 23 via pump conduit 22 and can be pumped through evaporator side condensate conduit 24 into the evaporator side 25 of the close coupled heat exchanger 38. In some embodiments, as shown in FIG. 5, a control valve 244 can be used in lieu of pump 23, depicted in FIG. 1, depending on the operating pressures of the system. In some embodiments, an additional and optional feedwater heat exchanger can be used in an embodiment to improve the evaporator process. In some embodiments, the feed water heat exchanger can be fluidly coupled with the condenser side condensate conduit 24 and the feedwater pump 23 and can heat a condensate exiting the pump 23.

The close coupling is employed to transfer energy between the evaporator side 25 (e.g., cold side) and condenser side 19 (e.g., hot side). The close coupling can be done through any conventional heat exchanger design such as a tube and shell, plate, or through an additional fluid transfer stage (not shown) such as a thermal oil and independent evaporator and condenser conduits. These thermal transfer techniques are known by those skilled in the art.

As shown in FIG. 1, the cold side condensate is circulated by pump 23 at approximately 5 MPa for this example through evaporator side condensate conduit 24. It is again noted that an infinite number of pressures are possible. The condensed water in evaporator side condensate conduit 24 is converted to saturated steam by accepting the released energy from the close coupled condenser side 19. The clean and exhaust constituent free steam product exits evaporator side 25 via evaporator side steam conduit 26. Again the combination of operating steam conversion pressures and conditions is near infinite in this method, apparatus and system. Another example is condenser side 19 may operate at 11 MPa and evaporator side may operate at 5 MPa.

The evaporator side steam, as shown in FIG. 1 (e.g., traveling through evaporator side steam conduit 26) can be supplemented by additional energy to improve its quality at an optional superheater 27. In some embodiments, the final steam product can be injected into the SAGD operation via a steam injection conduit 28 from the superheater 27 or can be extracted and injected into the SAGD operation via steam injection conduit 28 before optional superheater 27.

In some embodiments, the separator tank 21 can separate the hot side condensate into a water constituent and an exhaust constituent. The exhaust constituent, in some embodiments, can be processed through an optional turbo expander 29 to turn generator 30 to produce electricity 31, which could be used to self-power the site. Expanded exhaust constituents can be fed via an exhaust conduit 32 to an Air Pollution Control (APC) Process 33 before being exhausted via treated exhaust outlet 34. An optional APC process (e.g., afterburner or other organic processing device), for example APC 43 in FIG. 5, may be used.

FIG. 5 depicts a non-plasma assisted direct steam generation system with an optional plasma assisted vitrifier and an optional APC process fluidly coupled to an exhaust conduit and particulate cleaning system. As discussed in relation to FIG. 1, production wellbore 201 serves as a conduit for produced water and bitumen product associated with a SADG heavy oil operation. Production conduit 202 can be fluidly coupled to an oil separation system 203 and can carry the produced water and bitumen to the oil separation system 203. Crude oil conduit 204 can be fluidly coupled to the oil separation system 203 and can carry an end product of a SAGD operation. Separated water conduit 205 can be fluidly coupled to the oil separation system 203 and a feed water filtration system 206. Water filtered by the feed water filtration system 206 can be augmented by makeup water 208 and can be fed into a non-plasma assisted DSG 245 via feed conduit 235. The non-plasma assisted DSG can be provided oxygen and/or air via conduit 241. The non-plasma assisted DSG can include fossil fuel torches 211 that operate on fuels that include, but are not limited to well head gas, natural gas, propane, diesel, and/or bitumen. A saturated steam conduit 215 can be fluidly coupled to the DSG and sorbents and/or additives can be injected into the saturated steam conduit 215.

A particulate cleaning system 216 can be fluidly coupled to the saturated steam conduit 215 and can strip particulate matter from the saturated steam, as depicted in FIG. 4. Particulate matter can fall to the bottom of the particulate cleaning system 216 and can be fed to an optional PAV 242 via solid feed conduit 217. The PAV 242 can produce a vitrified product 214 from the particulate matter, which in some embodiments can be converted via a spinner wheel or forced cooling system, as discussed herein. The PAV 242 can be powered by plasma torches 210 and emissions can be fed to an APC process 250.

Saturated steam can be fed from the particulate cleaning system 216 via a saturated steam conduit 218 to a condenser side 219 of a multiphase combined (close coupled) heat exchanger 238, as discussed herein. Condensate from the condenser side 219 can be fed to a separator tank 221 via condenser side condensate conduit 220, which can separate the hot side condensate into a water constituent and an exhaust constituent. The exhaust constituent can include a percentage of CO2 by volume in a range from 20 percent to 100 percent. The exhaust constituent can be processed via an optional APC process 243 and turbo expander 229, which can provide for a controlled expansion. Expanded exhaust constituents can be fed via an exhaust conduit 232 to an APC process 233 before being exhausted via treated exhaust outlet 234.

As discussed herein, in some embodiments, a control valve 244 can control a flow of condensate through condensate conduit 224 into the evaporator side 225 of the close coupled heat exchanger 238. The condensate in the evaporator side 225 of the close coupled heat exchanger 238 can be converted to saturated steam and can be fed through evaporator side steam conduit 226 to the steam injection conduit 228, as discussed in relation to FIG. 1. In some embodiments, a heat exchanger can be fluidly coupled between the evaporator side of the close coupled heat exchanger and control valve 244 or between the control valve 244 and the separator tank 221.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the endoscope of the embodiments, the endoscope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It will be further appreciated that for conciseness and clarity, spatial terms such as "vertical," "horizontal," "up," and "down" may be used herein with respect to the illustrated embodiments. However, apparatus discussed herein may be used in many orientations and positions, and these terms are not intended to be limiting and absolute.

Although at least one embodiment for plasma assisted, dirty water, direct steam generation system, apparatus and method has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A system for generating steam, comprising:

a direct steam generator;

a feed conduit fluidly coupled to the direct steam generator configured for delivery of feedwater to the direct steam generator, wherein the feedwater includes organic and inorganic constituents;

a fossil fuel source fluidly connected to the direct steam generator to provide power to operate the direct steam generator;

at least one of an air conduit and an oxygen enriched air conduit fluidly coupled with the direct steam generator;

a close coupled heat exchanger fluidly coupled to the direct steam generator, the close coupled heat exchanger configured to route saturated steam and combustion exhaust constituents produced by the direct steam generator through a condenser portion of the close coupled heat exchanger via a condenser side steam conduit and configured to condense the saturated steam to form a condensate;

a throttling valve fluidly coupled between the direct steam generator and the condenser portion of the close coupled heat exchanger, wherein the throttling valve is located downstream of the direct steam generator and upstream of the condenser portion of the close coupled heat exchanger and is the only mechanically adjusted device that provides control over a pressure of the saturated steam routed to the close coupled heat exchanger;

a flash tank fluidly coupled between the direct steam generator and the condenser portion of the close coupled heat exchanger, wherein the flash tank captures particulate matter and feeds the particulate matter to a plasma assisted vitrifier, wherein the captured particulate matter is made up of solid material;

a solid feed conduit that includes a screw feeder, wherein the solid feed conduit couples the flash tank with the direct steam generator and the screw feeder delivers the solid material from the flash tank to the direct steam generator;

a separation tank and water return system fluidly coupled to a condenser side condensate conduit of the condenser portion of the close coupled heat exchanger, wherein the separation tank and water return system is configured to separate the combustion exhaust constituents from the condensate; and an evaporator portion of the close coupled heat exchanger fluidly coupled with the separation tank and water return system via an evaporator side condensate conduit, wherein the evaporator portion is configured to evaporate the condensate from the separation tank and water return system via heat transfer between the condenser portion and evaporator portion to form steam.

2. The system of claim 1, further comprising a superheater in fluid communication with the evaporator portion of the close coupled heat exchanger via an evaporator steam conduit, wherein the superheater is configured to further heat the steam formed by the evaporator portion to improve a quality of the steam.

3. The system of claim 1, wherein an additional heat exchanger is fluidly coupled with the condenser side condensate conduit and the separation tank and water return system.

4. The system of claim 1, wherein the direct steam generator includes a plasma assisted vitrifier, and wherein an inlet throttling valve is fluidly coupled between the condenser side steam conduit and the plasma assisted vitrifier.

5. The system of claim 1, wherein the at least one of the system further comprises a turbo expander fluidly coupled to the separation tank and water return system, wherein the turbo expander is configured to reclaim energy from the combustion exhaust constituents.

6. The system of claim 5, wherein the turbo expander is configured to generate electricity from the combustion exhaust constituents.

7. The system of claim 1, wherein the feedwater includes produced water.

8. The system of claim 1, wherein the feedwater includes produced water and dirty makeup water.

9. The system of claim 1, wherein the feedwater includes produced water, dirty makeup water, and bitumen process pond water.

10. The system of claim 1, wherein a reclaimed product selected from the group consisting of fiber, aggregate, and fracking sand is formed from the inorganic constituents of the feedwater.

11. The system of claim 1, wherein the oxygen enriched air includes a percentage of oxygen by volume in a range from 25 percent to 100 percent and wherein the separated combustion exhaust constituents include a percentage of $CO_2$ by volume in a range from 20 percent to 100 percent.

12. The system of claim 11, wherein the $CO_2$ from the separated combustion exhaust constituents is injected into a well.

13. The system of claim 11, wherein the $CO_2$ from the separated combustion exhaust constituents is injected into a storage location.

14. The system of claim 1, wherein a control valve is fluidly coupled between the separation tank and water return system.

15. The system of claim 1, further comprising a cyclone separator coupled with the flash tank, wherein the flash tank is located directly beneath the cyclone separator and the cyclone separator is configured to strip the particulate matter from the saturated steam.

16. The system of claim 15, wherein steam is flashed from a condensate provided to the flash tank from the cyclone separator, prior to the particulate matter being fed through the solid feed conduit to the direct steam generator.

17. The system of claim 16, wherein no water is included with the particulate matter being fed through the solid feed conduit to the direct steam generator.

18. The system of claim 1, wherein the solid matter is provided directly to the direct steam generator.

* * * * *